US007786941B2

(12) United States Patent
Tseng et al.

(10) Patent No.: US 7,786,941 B2
(45) Date of Patent: Aug. 31, 2010

(54) ANTENNA MODULE

(75) Inventors: Yi-Wei Tseng, Taipei County (TW); Tsung-Wen Chiu, Taipei County (TW); Fu-Ren Hsiao, Taipei County (TW); Sheng-Chih Lin, Taipei County (TW)

(73) Assignee: Advanced Connectek, Inc., Taipei County (TW)

( * ) Notice: Subject to any disclaimer, the term of this patent is extended or adjusted under 35 U.S.C. 154(b) by 176 days.

(21) Appl. No.: 12/182,806

(22) Filed: Jul. 30, 2008

(65) Prior Publication Data

US 2009/0040113 A1 Feb. 12, 2009

(30) Foreign Application Priority Data

Aug. 10, 2007 (TW) ..... 96129646 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 846, 830
See application file for complete search history.

(56) References Cited

U.S. PATENT DOCUMENTS 7,050,010 B2 * 5/2006 Wang et al. ..... 343/702
7,136,025 B2 * 11/2006 Lin et al. ..... 343/770
7,289,071 B2 * 10/2007 Hung et al. ..... 343/702

* cited by examiner

*Primary Examiner*—Shih-Chao Chen
(74) *Attorney, Agent, or Firm*—Schmeiser, Olsen & Watts LLP

(57) ABSTRACT

An antenna module is provided. The antenna module comprises a first radiation conductor, a second radiation conductor, a short-circuit element (s/c element), a ground plane, a feed-in cable and a spurious radiation conductor. One terminal of the second radiation conductor is near the first radiation conductor with a gap. One terminal of the s/c element is connected to the second radiation conductor and the other side of the s/c element is connected to the ground plane. The feed-in cable comprises a centre conductor and an external conductor, wherein the centre conductor is connected to the first radiation conductor and the external conductor is connected to the ground plane. The spurious radiation conductor is connected to the second radiation conductor. The second radiation conductor comprises a spurious radiation plate, a first radiation piece and a second radiation piece within the two sides of the second radiation conductor. The first radiation piece and a second radiation piece are in parallel and a gap is conducted between the first radiation piece and the second radiation piece.

10 Claims, 3 Drawing Sheets

ANTENNA MODULE

TECHNICAL FIELD

The present invention relates to an antenna module, and more particularly, to an antenna module with a spurious radiation conductor for generating low frequency resonant states.

BACKGROUND ART

In the case of mobile phone, the optimal resonant length for conventional resonant dipole antenna or patch antenna should be half of wavelength. If a wavelength is conducted according to the base band at 900 MHz, above wavelength is not implemental inside a cell phone. However, it could be overcome after a Planar Inverted-F Antenna is applied within. The Planar Inverted-F Antenna realizes an optimal resonant length with a quarter of wavelength mainly by using a shorting pin so as to place the antenna into the cell phone. However, when the shorting pin is applied, variations of resistances among the shorting pin are increased. That would narrow the bandwidth of the antenna down relatively. Therefore, metal shorting plate and metal shorting wall are designed for better bandwidth efficiency. At the same time, corresponding to the requirement of multi-frequency communication system, the surface of the Planar Inverted-F Antenna-is capable of being divided so as to divide an original complete resonant path into a plurality of resonant paths.

Alternatively, it could be conducted by extending the resonant paths in the way of extending conductor, or implementing the effect of multi-frequency and dividing-frequency by an arrangement for chip capacitors and inductors into the antenna.

In the view of the severe high bandwidth and low bandwidth requirements for dipole Planar Inverted-F Antenna, there are many improved structures provided. Please referring to FIG. 1, a conventional three-dimension view of the Planar Inverted-F Antenna is illustrated, the Planar Inverted-F Antenna comprises: a ground plane 13, a T-shape radiation metal element 14, a short-circuit (s/c) metal element 15, a coaxial transmit cable 16 and an adjutant metal pad 17, an s/c point 131 and a ground point 132 of the ground plane 13 close by an upside edge 133 of the ground plane 13. The T-shape radiation metal element 14 is located near the upside edge 133 of the ground plane 13. The T-shape radiation metal element 14 comprises: a first radiation element 141 substantially paralleled to the ground plane 13, a second radiation element 142 extending forward to an invert direction comparing with the first radiation element 141, a third radiation element 143, which is substantially vertical to the first radiation element 141 and the second radiation element 142, having a feed-in point 144.

The short-circuit metal element 15, formed as invert-L shape, is placed between the T-shape radiation metal element 14 and the ground plane 13. A centre conductor 161 of the coaxial transmit cable 16 is coupled to the feed-I point 132 of the third radiation element 143. The other ground conductor 162 is coupled to the ground point 132 of the ground plane 13. The adjutant metal pad 17 is electrically connected to the second radiation element 142. Above embodiment reaches the requirement of a transmission standard through combinations formed by modifications of the shape, length and width of the adjutant metal pad 17 and a corresponding location of the second radiation element 142 without increasing total size of the antenna.

However, the adjutant metal pad 17 is a C-shape piece and the modification must be conducted by bending whole metal pad, so that the adjutant process is not easy to execute. Therefore, the transmission bandwidth of its low-frequency base band is limited easily. In addition, the exactness for adjusting the length and width of the adjutant metal pad 17 is not easy to control. It must be consider as well the corresponding location of the adjutant metal pad 17 and the second radiation element 142. In conclusion, it's difficult to implement the production of the antenna and hard to accomplish the efficiency it claimed.

SUMMARY OF THE INVENTION

In accordance with one aspect of the invention, an antenna module is provided for generating a second low frequency resonant state of the antenna module easily and without complex adjusting processes by increasing spurious radiation conductor so as to increase transmission bandwidth of the low frequency and overcome disadvantages in conventional low frequency resonant structure. In addition, the structure of the antenna module is simple so that the antenna is with great precision and convenient manufacturing process.

In accordance with one aspect of the invention, an antenna module is provided. The antenna module, having a spurious radiation conductor with a first radiation piece and a second radiation piece, increases the matching efficiency of the antenna resonant state by adjusting resistance of the antenna module. Therefore, the antenna module is with better resistance bandwidth.

For above purpose of the present invention, an antenna module is provided. The antenna comprises a first radiation conductor, a second radiation conductor, an s/c element, a ground plane, a feed-in cable and a spurious radiation conductor. The first radiation conductor is formed substantially as an invert L shape and has a bottom side. The second radiation conductor having a coupled portion and an extending portion, wherein one side of the coupled portion is near to the bottom side of the first radiation conductor and with a gap, and the other side of the coupled portion is connected to the extending side. One terminal of the s/c element is connected to the side of the extending portion different from the side connected to the coupled portion. The feed-in cable comprises a centre conductor and an external conductor, wherein the centre conductor is connected to the first radiation conductor and the external conductor is connected to the ground plane. The spurious radiation conductor, which comprises a spurious radiation plate and a first radiation piece and a second radiation piece, is connected to one terminal of the extending portion different from the side connected to the coupled portion, wherein the terminals of the first radiation piece and the second radiation piece are with a gap in parallel.

The antenna module excites a high frequency resonant state by the first radiation conductor and generates a first low frequency resonant state via the extending portion and the s/c element. In addition, a second low frequency resonant state of the antenna module is conducted so as to increase the transmission bandwidth of the low frequency bandwidth. The radiation plate is applied by metal wires or metal patches and the terminals of the first radiation piece and the second radiation piece are with a gap between each other in parallel. The gap is applied for generating capacitor coupling effect so as to increase the resistance efficiency of the low frequency resonant state of the antenna module.

One or part or all of these and other features and advantages of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

DESCRIPTION OF THE EMBODIMENT

Reference will now be made in detail to the embodiments of the present invention. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, and components have not been described in detail as not to unnecessarily obscure aspects of the present invention.

Figure 1:
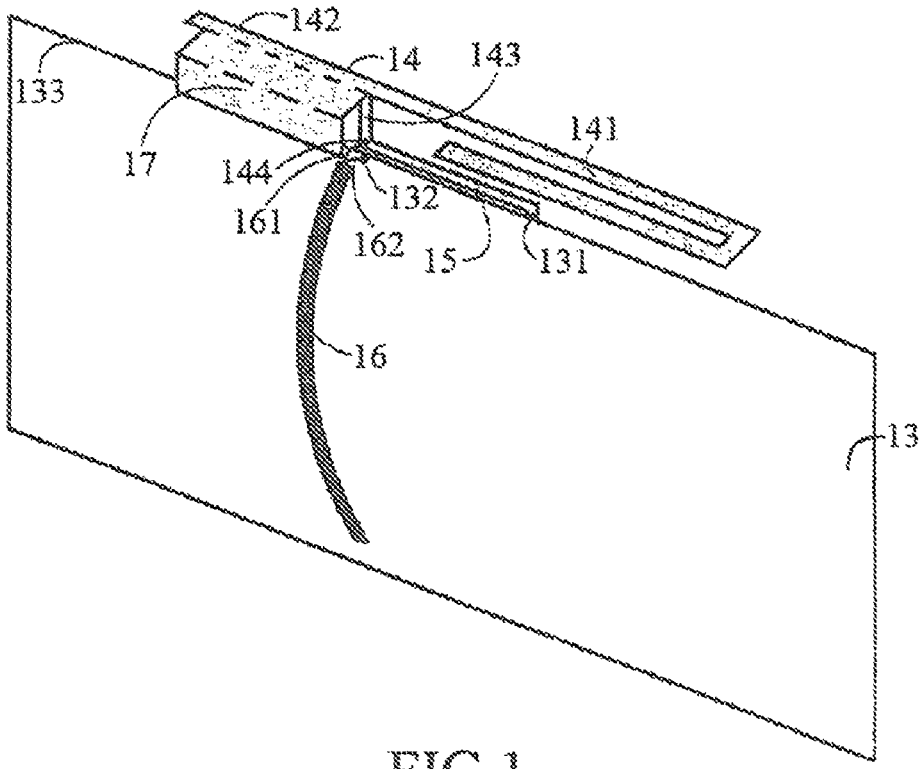
FIG.1 PRIOR ART
FIG. 1 is a conventional three-dimension view of the Planar Inverted-F Antenna.
Figure 2:
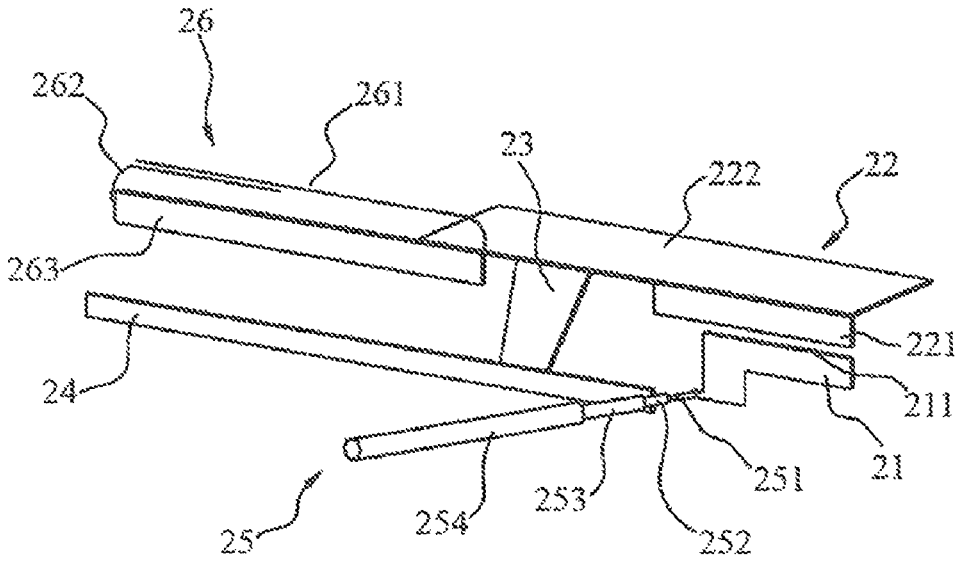
FIG. 2 is a three-dimension view of an antenna module according to a first embodiment of the present invention.

Please refer to FIG. 2, a three-dimension view of an antenna module according to a first embodiment of the present invention is illustrated. The antenna module comprises a first radiation conductor 21, a second radiation conductor 22, an s/c element 23, a ground plane 24, a feed-in cable 25 and a spurious radiation conductor 26.

The first radiation conductor 21, similarly to L-shape, further comprises a bottom side 211. The second radiation conductor 22 comprises a coupled portion 221 and an extending portion 222, a side margin of the coupled portion 221 is configured near the bottom side 211 of the first radiation conductor 21 with a gap, wherein the counter side is connected to the extending portion 222. The coupled portion 221 and extending portion 222 are vertical with each other. The s/c element 23, similarly to T-shape, is connected to the extending portion 222 with one terminal and connected to the ground plane 24 with another terminal. The feed-in cable 25, transmitting electrical signals to the antenna module, comprises a centre conductor 251, an internal isolated layer 252, an external conductor 253 and an external isolated layer 254. The centre conductor 251 is connected to the first radiation conductor 21. The external conductor 253 is connected to the ground plane 24. The internal isolated layer 252 isolates the electrical signals transmitted by the external conductor 253 from the centre conductor 251 so as to avoid influences from each other.

The spurious radiation conductor 26 is connected to a terminal different with the one connected to the coupled portion 221 of the expending portion 222. The spurious radiation conductor 26 comprises a spurious radiation plate 263, a first radiation piece 261 and a second radiation piece 262, wherein a terminal of the first radiation piece 261 is in parallel with a terminal of the second radiation piece 262 with a gap. In this embodiment of the present invention, the first radiation piece 261 and the second radiation piece 262 are consisted of metal wires.

In this embodiment, the length of the bottom side 211 of the first radiation conductor 21 is about 19 mm, and lengths near the bottom side 211 is 5 mm and 1.5 mm relatively, wherein 5 mm is the peripheral width of the first radiation conductor 21, and a length of the opposite side of the bottom side 211 is about 2 mm. The gap between the coupled portion 221 and the first radiation conductor 21 is about 0.5 mm. The length of the coupled portion 221 is about 26 mm, and the width of the coupled portion 221 is about 1.5 mm. The long side of the extending portion 222 is about 44 mm, and the short side of the extending side of the extending portion 222 is about 5 mm. The short bottom side of the s/c element 23 is about 2 mm, the long bottom side of the s/c element 23 is about 4 mm and the length of the coupled portion 221 is about 26 mm, and the width of the s/c element 23 is about 7 mm. The length of the ground plane 24 is about 62 mm, and the width of the ground plane 24 is about 1 mm. The length of the spurious radiation plate 263 is about 42 mm, and the width of the spurious radiation plate 263 is about 1 mm. The length of the first radiation piece 261 is about 36 mm, and the length of the second radiation piece is about 27 mm.

The antenna module of the embodiment of the present invention generates a low frequency resonant state by exciting the first radiation conductor 21 into a high frequency resonant state and feeding the feed-in signal into the extending portion 222 and the s/c element 23. In the same time, a spurious radiation conductor 26 connected to the extending portion 222 is configured so as to generate a second low frequency resonant state. Therefore, the bandwidth of the low frequency operating band is increasing, and also increasing the radiation conducting efficiency of the antenna module through utilizing the high radiation conduct characteristic of the metallic first radiation piece 261 and the metal second radiation piece 262. The embodiment of the present increases the radiation conduct efficiency of the antenna module via the control for configuring the length and the width of the first radiation piece 261 and second radiation piece 262.

Therefore, the resistance of the antenna module is adjusted for better resistance variance and better bandwidth effect. The gap between the first radiation piece 261 and the second radiation piece 262 increases resistance efficiency of the low frequency state of the antenna module by the capacitor coupling effect of the gap.

Figure 3:
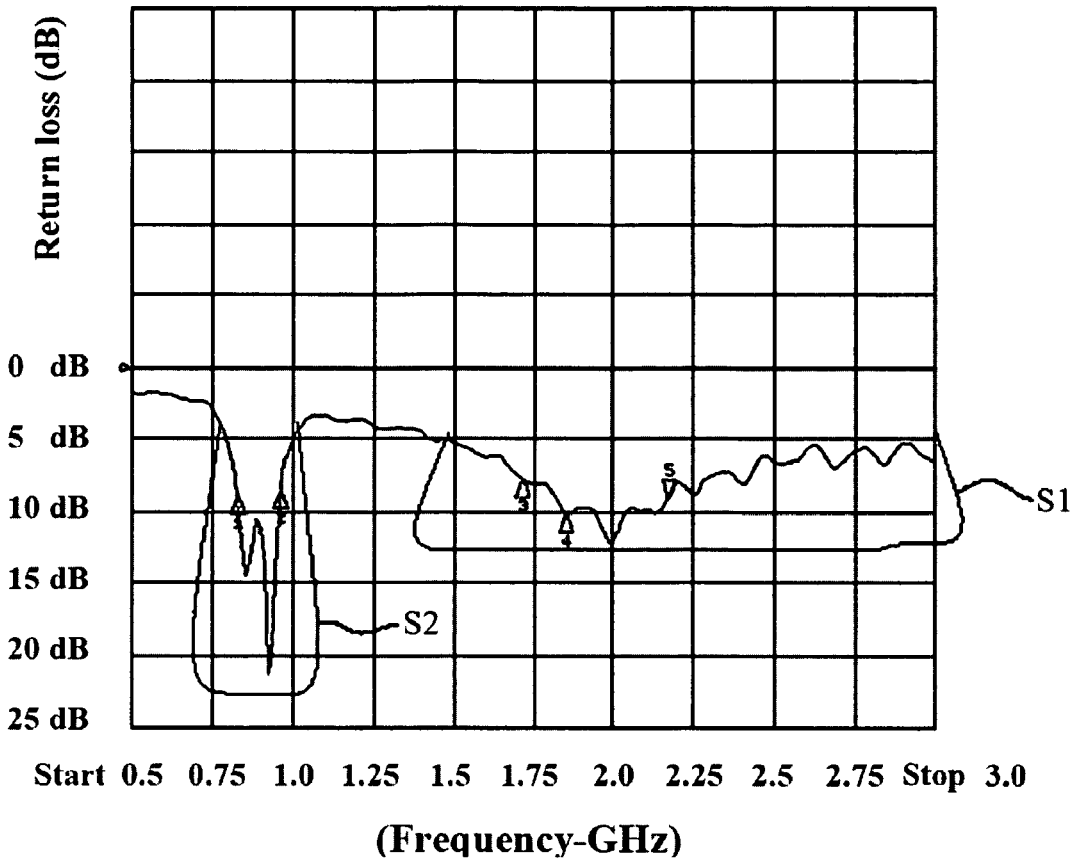
FIG. 3 is a return loss measuring data diagram of the first embodiment of the present invention

Referring to FIG. 3, a return loss measuring data diagram of the first embodiment of the present invention is illustrated. A high bandwidth S1 of the operating frequency of the antenna is about 1080 MHz (cover 1570 MHz to 2650 MHz) when the return loss measuring data diagram is defined as −6 dB. The range of the high bandwidth S1 covers the system bandwidths of GPS (1575 MHz), CS (1710~1880 MHz), PCS (1850~1990 MHz), UMTS (1920~2170 MHz) and WLAN802.11b/g (2400~2500 MHz). The low frequency S2, about 200 MHz (cover 790 MHz to 990 MHz), covers the system bandwidth of the AMPS (824~894 MHz) and GSM (880~960 MHz). According to above discloses, the spurious radiation conductor 26 of the embodiment of the present invention and the second radiation conductor 22 synthesize a more convenient operating bandwidth of the low frequency band range. The first radiation piece 261 and the second radiation piece 262 are applied for adjusting resistance and providing an optimal resistance bandwidth for the antenna module.

Figure 4:
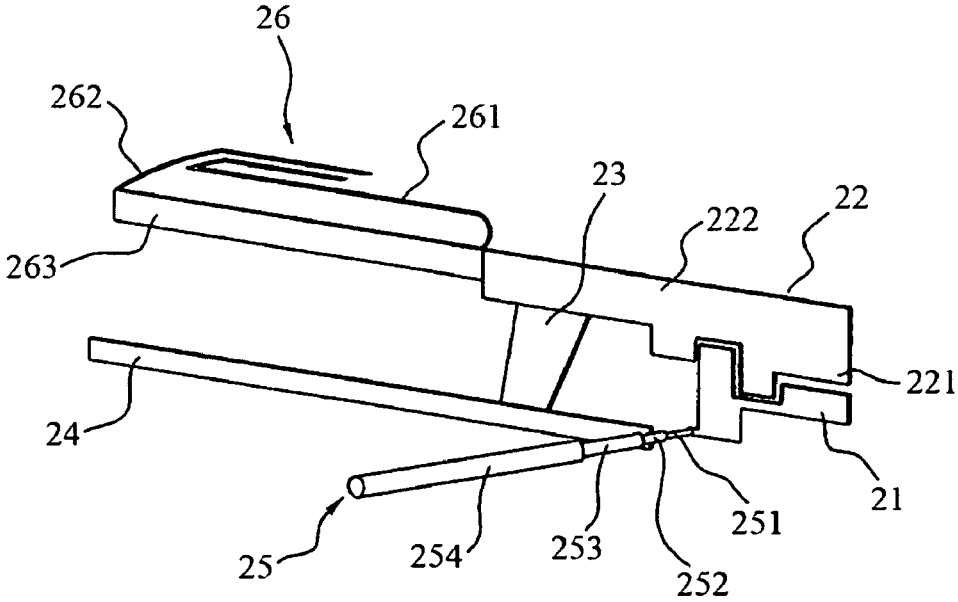
FIG. 4 is a three-dimension view of an antenna module according to a second embodiment of the present invention.

Please referring to FIG. 4, a three-dimension view of an antenna module according to a second embodiment of the present invention is illustrated. The gap between the coupled portion 221 and the first radiation conductor 21 is shaped with multiple curves. When the feed-in signal of the first radiation conductor 21 is coupled to the coupled portion 221, the efficiency of electrical coupled effect is increased by extending the electrical coupler path and the electrical coupler of the multiple curves gap according to the electrical coupled effect. The extending portion 222 is also capable of locating at the same plane with the coupled portion 221 and in parallel with each other. The first radiation piece 261 is configured at a location near the connecting portion between the extending portion 222 and the spurious radiation plate 263. The first radiation piece 261 and the second radiation piece 262 may be applied with metallic material so as to increase radiation transmission efficiency of the antenna module by the high radiation transmission characteristic of the metallic material.

The resistance of the antenna module is adjusted by controlling lengths and widths of the first radiation piece 261 and the second radiation piece 262 so that the antenna module has an optimal resistance bandwidth and better variance of resistance. The terminals of the first radiation piece 261 and the second radiation piece 262 are in parallel with each other and a gap between the first radiation piece 261 and the second radiation piece 262 is conducted so as to increase resistance efficiency of low frequency resonant of the antenna module via capacitor coupling effect.

Figure 5:
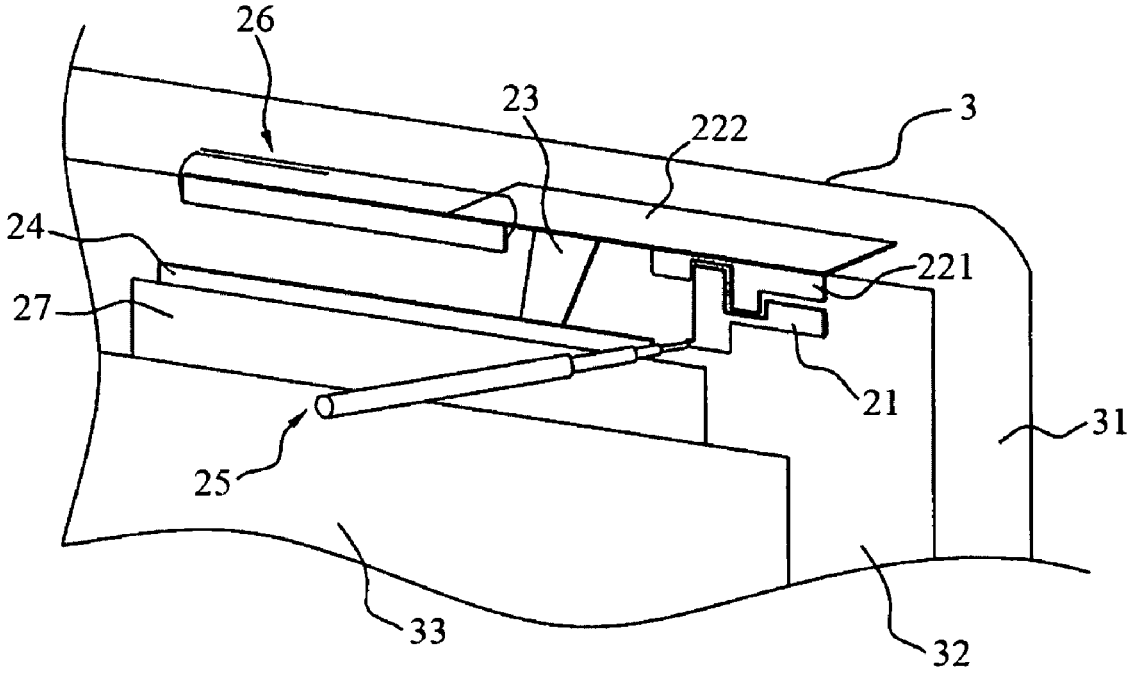
FIG. 5 is a detail 3-D part diagram of the first embodiment applying to a laptop computer

Please referring to FIG. 5, a detail 3-D part diagram of the first embodiment applying to a laptop computer is illustrated. The antenna module is applied in a laptop computer 3. In detail, the antenna module is attached on a surface of a side frame 31 of the laptop computer 3. One portion of a metal plate 27 is pasted on the ground plane 24 of the antenna module, and the other portions of the metal plate 27 are completely pasted on the bottom frame 32 of the laptop computer 3. Therefore, signals of the ground plane 24 of the antenna module are transmitted to a ground plane 24 of the laptop computer 3. In practice, the metal plate 27 is capable of being an aluminum foil.

The spurious radiation conductor 26 of the present invention is configured by the first radiation piece 261 and the second radiation piece 262 with simple structure and convenient configuration, as shown in FIG. 4. The spurious radiation conductor 26 is capable of integrating into different electrical devices and the radiation item is easy to be modified. Therefore, the present invention is out the limitation of angles and space. In conclusion, the conventional disadvantages in lack of the low frequency band width are overcome by increasing operating band range of the low frequency bandwidth.

Foregoing descriptions and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. An antenna module, comprising:

a first radiation conductor, substantially as invert L-shape, having a bottom side;

a second radiation conductor, further comprising a coupled portion and an extending portion, wherein one terminal of the coupled portion is near the bottom side of the first radiation conductor with a gap and the other terminal of the coupled portion is connected to the extending portion;

a short-circuit element having a terminal connected to a terminal of the extending portion different from the terminal connected with the coupled portion;

a ground plane, connected to the other terminal of the short-circuit element;

a feed-in cable further comprising a centre conductor and an external conductor, wherein the centre conductor is connected to the first radiation conductor and the external conductor is connected to the ground plane; and a spurious radiation conductor, connected to a terminal of an extending terminal different from the terminal connected with the coupled portion, further comprising a spurious radiation plate, a first radiation piece and a second radiation piece within the two sides of the second radiation conductor, wherein a terminal of the first radiation piece is in parallel with a terminal of the second radiation piece with a gap.

2. The antenna module as cited in claim 1, wherein the coupled portion and the extending portion are located at the same plane.

3. The antenna module as cited in claim 1, wherein the coupled portion and the extending portion are located at vertical planes.

4. The antenna module as cited in claim 1, wherein the gap is formed as multiple curves shape.

5. The antenna module as cited in claim 1, wherein the gap is applied for generating an electrical coupling effect.

6. The antenna module as cited in claim 1, wherein the first radiation piece and the second radiation piece is consisted of metal wires.

7. The antenna module as cited in claim 1, wherein the first radiation piece and the second radiation piece is consisted of metal patches.

8. The antenna module as cited in claim 1, wherein the first radiation piece is consisted of metal wires, the second radiation piece is consisted of metal patches.

9. The antenna module as cited in claim 1, wherein the first radiation piece is consisted of metal patches, the second radiation piece is consisted of metal wires.

10. The antenna module as cited in claim 1, wherein the gap is applied for a capacitor coupled effect.

* * * * *